US005789373A

United States Patent [19]

Baker et al.

[11] Patent Number: 5,789,373

[45] Date of Patent: Aug. 4, 1998

[54] LAUNDRY ADDITIVE COMPOSITIONS INCLUDING DISPERSIBLE POLYOLEFIN

[76] Inventors: Ellen Schmidt Baker, 10083 Bennington Dr., Cincinnati, Ohio 45241; Frederick Anthony Hartman, The Procter & Gamble Company, Miami Valley Laboratories, P.O. Box 538707, Cincinnati, Ohio 45253-8707; Bruno Albert Jean Hubesch; Axel Masschelein, both of Procter & Gamble ETC, Temselaan, 100, B-1853 Strombeek-Bever, Belgium

[21] Appl. No.: 594,956

[22] Filed: Jan. 31, 1996

[51] Int. Cl.[6] ..... C11D 7/32

[52] U.S. Cl. ..... 510/522; 510/253; 510/284; 510/393; 510/475; 510/499; 510/524; 510/525

[58] Field of Search ..... 510/475, 284, 510/283, 522, 525, 524, 393, 529, 499

[56] References Cited

U.S. PATENT DOCUMENTS

| | | | |
|---|---|---|---|
| 3,475,207 | 10/1969 | Berch et al. | 117/143 |
| 3,565,840 | 2/1971 | Mirabile et al. | 260/23 |
| 3,574,520 | 4/1971 | Aldrich | 8/115.6 |
| 3,734,686 | 5/1973 | Douglas | 8/137 |
| 3,749,691 | 7/1973 | Kandathil | 260/29.6 |
| 3,822,145 | 7/1974 | Liebowitz et al. | 117/139.5 |
| 3,826,682 | 7/1974 | Liebowitz et al. | 117/139.5 |
| 3,984,335 | 10/1976 | Ciko et al. | 252/8.6 |
| 4,089,786 | 5/1978 | Ciko et al. | 252/8.8 |
| 4,211,815 | 7/1980 | Deiner | 428/290 |
| 4,252,656 | 2/1981 | Liebowitz et al. | 252/8.8 |
| 4,347,145 | 8/1982 | Gregorian | 8/477 |
| 4,426,304 | 1/1984 | Ciko et al. | 252/8.75 |
| 4,474,668 | 10/1984 | Petzold et al. | 252/8.6 |
| 4,767,547 | 8/1988 | Straathof et al. | 252/8.8 |
| 4,975,091 | 12/1990 | Becker et al. | 8/115.66 |
| 5,019,281 | 5/1991 | Singer et al. | 252/8.8 |
| 5,047,065 | 9/1991 | Vogel et al. | 8/115.6 |
| 5,051,250 | 9/1991 | Patel et al. | 424/70 |
| 5,078,747 | 1/1992 | Kastele et al. | 8/181 |
| 5,185,088 | 2/1993 | Hartman et al. | 252/86 |
| 5,213,716 | 5/1993 | Patel et al. | 252/547 |
| 5,238,731 | 8/1993 | Blanch et al. | 428/266 |
| 5,310,783 | 5/1994 | Bernheim et al. | 524/837 |
| 5,346,642 | 9/1994 | Patel et al. | 252/174.21 |
| 5,460,736 | 10/1995 | Trinh et al. | 510/524 |
| 5,514,302 | 5/1996 | Brown | 510/280 |
| 5,599,786 | 2/1997 | Siklosi | 510/522 |

FOREIGN PATENT DOCUMENTS

| | | | |
|---|---|---|---|
| 118611 | 9/1984 | European Pat. Off. | D06M 13/16 |
| 412 324 | 2/1991 | European Pat. Off. | D06M 15/227 |
| 0462806 | 12/1991 | European Pat. Off. . | |
| 535 437 | 4/1993 | European Pat. Off. | D06M 15/643 |
| 535 438 | 4/1993 | European Pat. Off. | D06M 15/17 |
| 1900002 | 7/1970 | Germany . | |
| 234 687 | 4/1986 | Germany | C11D 01/62 |
| 3926-005 | 2/1991 | Germany | C08J 03/05 |
| 1162898 | 8/1969 | United Kingdom | C07C 69/52 |
| WO 91/19037 | 12/1991 | WIPO | D06M 15/643 |

OTHER PUBLICATIONS

U.S. application No. 08/594457, Mermelstein et al., filed Jan. 31, 1996.

U.S. application No. 08/594,546, Hartman et al., filed Jan. 31, 1996.

*Primary Examiner*—Douglas J. McGinty
*Assistant Examiner*—Lorna M. Douyon
*Attorney, Agent, or Firm*—Kim William Zerby; Brian M. Bolam; Richard S. Echler, Sr.

[57] ABSTRACT

Laundry additive compositions and methods for their use are provided. The compositions include a dispersible polyolefin, preferably polyethylene, and at least one compound selected from the group consisting of dye fixative agents, chelating agents, dye transfer inhibiting agents, chlorine scavenging agents, free radical scavenging agents, cellulase enzymes and mixtures thereof. Preferably, the composition is a liquid composition added to the rinse cycle of a consumer laundry process or to a pre-treatment cycle before a wash cycle of a consumer laundry process.

13 Claims, No Drawings

LAUNDRY ADDITIVE COMPOSITIONS INCLUDING DISPERSIBLE POLYOLEFIN

TECHNICAL FIELD

The present invention relates to laundry additive compositions including dispersible polyolefin and methods for using the same. More particularly, the present invention relates to laundry additive compositions including dispersible polyolefin which improve various properties, such as color appearance, wrinkle reduction, and improved water absorbency of fabrics to which they are applied.

BACKGROUND OF THE INVENTION

In recent years, consumer desirability for durable press fabric garments, particularly cotton fabric garments, has risen. Durable press garments include those garments which resist wrinkling of the fabric both during wear and during the laundering process. Durable press garments can greatly decrease the hand work associated with laundering by eliminating ironing sometimes necessary to prevent wrinkling of the garment. However, in most commercially available durable press fabrics, the fabric's ability to resist wrinkling is reduced over time as the garment is repeatedly worn and laundered.

Furthermore, colored garments have a tendency to wear and show appearance losses. A portion of this color appearance loss may be attributed to abrasion in the laundering process, particularly in automatic washing machines and automatic laundry dryers.

Consumer desirability for laundry additive compositions has also risen. The popularity of laundry additive compositions has risen due to the consumers desire to impart various desirable properties to fabrics easily and quickly during the laundry process. A wide variety of ingredients have been suggested for use in laundry additive compositions to enhance the appearance and feel of fabrics. Detergents, of course, provide a basic cleaning function. Fabric softeners provide both softening and anti-static benefits to fabrics. More, recently cellulase enzymes have been employed to improve the appearance of colored garments. Perfumes deliver pleasing odors and freshness.

While fabric softening components provide anti-static, softness, color appearance and antiwrinkle benefits, they do have several drawbacks. Fabric softness of laundered garments is typically achieved by delivering a quaternary ammonium compound to the surface of the fabric. However, due to the fatty character of many of the quaternary ammonium compounds commercially employed as fabric softening agents, the ability of fabrics treated with these agents to absorb water may decrease. This decrease in water absorbency can be undesirable for certain fabric articles such as terry towels where water absorbency is an important feature.

Accordingly, there is a need for a laundry additive composition, and, in particular, a pre-soak or rinse added laundry additive which can provide, refurbish or restore color appearance fabrics, as well as provide anti-wrinkling and fabric anti-wear properties. This need is met by the present invention wherein a laundry additive composition is provided. The improved laundry additive composition of the present invention includes a dispersible polyolefin and provides color appearance, anti-wrinkling and fabric anti-wear properties to garments which have been laundered in the composition.

BACKGROUND ART

U.S. Pat. Nos. 3,984,335 and 4,089,786 disclose souring and softening compositions for textile fabrics. U.S. Pat. No. 3,749,691 discloses detergent compatible fabric softening compositions. European Patent 118,611 discloses compositions for softening fibrous materials, particularly textile fabrics. U.S. Pat. No. 3,734,686 discloses compositions for treating carpet and pile fabrics. U.S. Pat. No. 3,822,145 discloses fabric softening foams which are sprayed into a tumble dryer. U.S. Pat. No. 5,019,281 discloses softhand agents for textile applications. Japanese Patent Application JP53035085 discloses aerosol sizing agents. Indian Patent Application 167973 A discloses a mixed catalyst system for producing durable press fabrics. European Patent 0 535 438 A1 discloses a polyethylene solution for treating textiles. U.S. Pat. No. 4,474,668 discloses smoothing agents for textile fibers. U.S. Pat. No. 4,252,656 discloses foam conditioners for fabrics. U.S. Pat. No. 3,574,520 discloses solutions for treating cellulosic garments. U.S. Pat. No. 5,019,281 discloses hydrophilic softhand agents for fibrous materials.

SUMMARY OF THE INVENTION

The present invention relates to laundry additive compositions which provide color appearance, anti-wrinkle, improved water absorbency, and fabric anti-wear properties. In accordance with a first aspect of the present invention, a laundry additive composition is provided. The composition comprises:

from about 0.1% to about 50% by weight of the composition of a dispersible polyolefin and at least one component selected from the group consisting of:

i) from about 0.1% to about 15% by weight of the composition of a dye fixative agent;

ii) from about 0.1% to about 15% by weight of the composition of a chelating agent;

iii) from about 0.1% to about 15% by weight of the composition of a dye transfer inhibiting agent;

iv) from about 0.1% to about 15% by weight of the composition of a chlorine scavenging agent;

v) from about 0.1% to about 25% by weight of the composition of a free radical scavenging agent; and vi) from about 0.1 CEVU/g to about 125 CEVU/g of the composition of a cellulase enzyme vii) mixtures thereof, and the balance a carrier material.

The dispersible polyolefin is preferably added as an emulsion or suspension of polyolefin. The emulsion may comprise from about 10% to about 35% by weight of polyolefin and an emulsifier. The ratio of emulsifier to polyolefin in the emulsion may be from about 1:5 to about 3:1. The polyolefin is preferably polyethylene and most preferably an oxidized polyethylene. The emulsifier is preferably a cationic, anionic or nonionic surfactant. When added as an emulsion or suspension of polyolefin, the emulsion or suspension is preferably added at sufficient levels to provide from about 1 to about 35% by weight dispersible polyolefin in the composition.

In accordance with another aspect of the present invention, a liquid pre-soak or rinse added laundry additive composition is provided. The composition comprises:

from about 1% to about 30% by weight of the composition of a dispersible polyolefin;

from about 0.25% to about 10% by weight of the composition of a compound a dye fixative agent;

from about 0.5% to about 10% by weight of the composition of a chelating agent;

from about 0.25% to about 5% by weight of the composition of a chlorine scavenging agent; and the balance a liquid carrier selected from the group consisting of: water; $C_{1-4}$ monohydric alcohol; $C_{2-6}$ polyhydric alcohol; propylene carbonate; liquid polyethylene glycols; and mixtures thereof.

The dispersible polyolefin is preferably added as a polyethylene emulsion or suspension and more preferably an oxidized polyethylene emulsion or suspension. When adding the polyolefin as an emulsion or suspension, the emulsion or suspension of polyolefin is preferably added at sufficient levels to provide from about 1% to about 30% by weight of the composition. The composition may further include at least one of the group consisting of cellulase enzymes, dye transfer inhibiting agents and free radical scavenging agents.

In accordance with still another aspect of the present invention, a method for laundering fabrics is provided. The method comprises contacting the fabrics with an aqueous medium containing at least 50 ppm of the laundry additive compositions as described above. More preferably the laundry additive composition is added during the rinse cycle or as a pretreatment prior to the wash cycle.

Accordingly, it is an object of the present invention to provide a laundry additive composition. It is another object of the present invention to provide a liquid pre-soak or rinse added laundry additive composition. It is still another object of the present invention to provide a liquid, pre-soak or rinse added laundry additive product which imparts color appearance, anti-wrinkle properties, static control, water absorbency and fabric anti-wear properties. These, and other, objects, features and advantages will be clear from the following detailed description and the appended claims.

All percentages, ratios and proportions herein are on a weight basis unless otherwise indicated. All documents cited herein are hereby incorporated by reference.

DETAILED DESCRIPTION OF THE PREFERRED EMBODIMENTS

The present invention provides laundry additive compositions and methods for using the compositions. The compositions include various ingredients such as a dispersible polyolefin in combination with various other laundry additive components. The laundry additive compositions of the present invention provide superior fabric care properties including color appearance, wrinkle-free, improved water absorbency and fabric anti-wear properties.

I. Polyolefin

The laundry additive compositions of the present invention include a dispersible polyolefin. Preferably, the polyolefin is a polyethylene, polypropylene or mixtures thereof. The polyolefin may be at least partially modified to contain various functional groups, such as carboxyl, alkylamide, sulfonic acid or amide groups. More preferably, the polyolefin employed in the present invention is at least partially carboxyl modified or, in other words, oxidized. In particular, oxidized or carboxyl modified polyethylene is preferred in the compositions of the present invention.

For ease of formulation, the polyolefin is preferably introduced as a suspension or an emulsion of polyolefin dispersed by use of an emulsifing agent. The polyolefin suspension or emulsion preferably has from about 1 to about 50%, more preferably from about 10 to about 35% by weight, and most preferably from about 15 to about 30% by weight of polyolefin in the emulsion. The polyolefin preferably has a molecular weight of from about 1,000 to about 15,000 and more preferably from about 4,000 to about 10,000.

When an emulsion is employed, the emulsifier may be any suitable emulsification or suspending agent. Preferably, the emulsifier is a cationic, nonionic, zwitterionic or anionic surfactant or mixtures thereof. Most any suitable cationic, nonionic or anionic surfactant may be employed as the emulsifier of the present invention. Preferred emulsifiers of the present invention are cationic surfactants such as the fatty amine surfactants and in particular the ethoxlated fatty amine surfactants. In particular, the cationic surfactants are preferred as emulsifiers in the present invention. The polyolefin is dispersed with the emulsifier or suspending agent in a ratio of emulsifier to polyolefin of from about 1:10 to about 3:1. Preferably, the emulsion includes from about 0.1 to about 50%, more preferably from about 1 to about 20% and most preferably from about 2.5 to about 10% by weight of emulsifier in the polyolefin emulsion. Polyethylene emulsions and suspensions suitable for use in the present invention are available under the tradename VELUSTROL from HOECHST Aktiengesellschaft of Frankfurt am Main, Germany. In particular, the polyethylene emulsions sold under the tradename VELUSTROL PKS, VELUSTROL KPA, or VELUSTROL P-40 may be employed in the compositions of the present invention.

The compositions of the present invention may contain from about 0.1% to about 50% by weight of the polyolefin. More preferably, the compositions include from about 1% to about 35% by weight and most preferably from about 1% to about 30% by weight of the polyolefin. When the polyolefin is added to the compositions of the present invention as an emulsion or suspension, the emulsion or suspension is added at sufficient enough quantities to provide the above noted levels of dispersible polyolefin in the compositions.

II. Dye Fixative Agents

The compositions of the present invention may also include a dye fixative agent. Dye fixing agents, or "fixatives", are well-known, commercially available materials which are designed to improve the appearance of dyed fabric by minimizing the loss of dye from fabrics due to washing. Many dye fixatives are cationic, and are based on various quaternized or otherwise cationically charged organic nitrogen compounds. Fixatives are available under various trade names from several suppliers. Representative examples include: CROSCOLOR PMF (July 1981, Code No. 7894) and CROSCOLOR NOFF (January 1988, Code No. 8544) from Crosfield; INDOSOL E-50 (Feb. 27, 1984, Ref No. 6008.35.84; polyethyleneamine-based) from Sandoz; SANDOFIX TPS, which is also available from Sandoz and is a preferred polycationic fixative for use herein and SANDOFIX SWE (cationic resinous compound), REWIN SRF, REWIN SRF-O and REWIN DWR from CHT-Beitlich GMBH.

Other cationic dye fixing agents are described in "Aftertreatments for improving the fastness of dyes on textile fibres" by Christopher C. Cook (REV. PROG. COLORATION Vol. 12, 1982). Dye fixing agents suitable for use in the present invention are ammonium compounds such as fatty acid—diamine condensates e.g. the hydrochloride, acetate, metosulphate and benzyl hydrochloride of oleyldiethyl aminoethylamide, oleylmethyldiethylenediaminemethsulphate, monostearyl-ethylene diaminotrimethylammonium methosulphate and oxidized products of tertiary amines; derivatives of polymeric alkyldiamines, polyamine-cyanuric chloride condensates and aminated glycerol dichlorohydrins.

The amount of dye fixing agent to be employed in the composition of the invention is preferably from about 0.01

% to about 15% by weight of the composition, more preferably from about 0.1% to about 15% by weight, most preferably from about 0.25% to about 10% by weight of the composition.

III. Chelating Agent

The compositions and processes herein employ one or more heavy metal (copper, iron, etc.) chelating agents ("chelators"). Such water-soluble chelating agents can be selected from the group consisting of amino carboxylates, amino phosphonates, polyfunctionally-substituted aromatic chelating agents and mixtures thereof, all as hereinafter defined. Without intending to be bound by theory, it is believed that the benefit of these materials is due in part to their exceptional ability to remove copper and nickel ions (as well as other cations such as manganese, iron, and the like) from aqueous solutions by formation of soluble chelates. Surprisingly, these chelating agents also appear to interact with dyes and optical brighteners on fabrics which have already been undesirably affected by interactions with copper or nickel cations in the laundry process, with the attendant color change and/or drabness effects. By the present invention, the color, whiteness and/or brightness of such affected fabrics are substantially improved or restored.

Amino carboxylates useful as chelating agents herein include ethylenediaminetetraacetates (EDTA), N-hydroxyethylethylenediaminetriacetates, nitrilotriacetates (NTA), ethylenediamine tetraproprionates, ethylenediamine-N,N'-diglutamates, 2-hyroxypropylenediamine-N,N'-disuccinates, triethylenetetraaminehexacetates, diethylenetriaminepentaacetates (DETPA), and ethanoldiglycines, including their water-soluble salts such as the alkali metal, ammonium, and substituted ammonium salts thereof and mixtures thereof.

Amino phosphonates are also suitable for use as chelating agents in the compositions of the invention when at least low levels of total phosphorus are permitted in detergent compositions, and include ethylenediaminetetrakis (methylenephosphonates), diethylenetriamine-N,N,N',N", N"-pentakis(methane phosphonate) (DETMP) and 1-hydroxyethane-1,1-diphosphonate (HEDP). Preferably, these amino phosphonates do not contain alkyl or alkenyl groups with more than about 6 carbon atoms.

The chelating agents are typically used in the preferred aqueous compositions to provide levels in aqueous solution of from about 2 ppm to about 50 ppm.

The preferred EDDS chelator used herein (also known as ethylenediamine-N,N'-disuccinate) is the material described in U.S. Pat. No. 4,704,233, cited hereinabove, and has the formula (shown in free acid form):

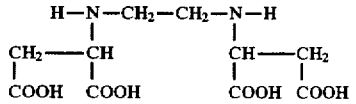

As disclosed in the patent, EDDS can be prepared using maleic anhydride and ethylenediamine. The preferred biodegradable [S,S] isomer of EDDS can be prepared by reacting L-aspartic acid with 1,2-dibromoethane. The EDDS has advantages over other chelators in that it is effective for chelating heavy metal cations, is available in a biodegradable form, and does not contain phosphorus. The EDDS employed herein as a chelator is typically in its salt form, i.e., wherein one or more of the four acidic hydrogens are replaced by a water-soluble cation M, such as sodium, potassium, ammonium, triethanolammonium, and the like. As noted before, the EDDS chelator is also typically used in the present compositions and methods at levels which will provide from about 2 ppm to about 50 ppm for periods from 1 minute up to several hours' soaking.

As can be seen from the foregoing, a wide variety of chelators can be used herein. Indeed, simple polycarboxylates such as citrate, oxydisuccinate, and the like, can also be used, although such chelators are not as effective as the amino carboxylates and phosphonates, on a weight basis. Accordingly, usage levels may be adjusted to take into account differing degrees of chelating effectiveness. The chelators herein will preferably have a stability constant (of the fully ionized chelator) for copper ions of at least about 5, preferably at least about 7. Typically, the chelators will comprise from about 0.1% to about 15%, more preferably from about 0.1% to about 10%, and most preferably from about 0.5% to about 10%, by weight of the compositions herein. Preferred chelators include DETMP, DETPA, NTA, EDDS and mixtures thereof.

IV. Chlorine Scavenging Agents

Chlorine is used in many parts of the world to sanitize water. To ensure that the water is safe, a small residual amount, typically about 1 to 2 parts per million (ppm), of chlorine is left in the water. At least about 10% of U.S. households has about 2 ppm or more of chlorine in its tap water at some time. It has been found that this small amount of chlorine in the tap water can also contribute to fading or color changes of some fabric dyes. Thus, chlorine-induced fading of fabric colors over time can result from the presence of residual chlorine in the wash or rinse water. Accordingly, the present invention preferably also employs a chlorine scavenger. Moreover, the use of such chlorine scavengers provides a secondary benefit due to their ability to eliminate or reduce the chlorine odor on fabrics.

Chlorine scavengers are materials that react with chlorine, or with chlorine-generating materials, such as hypochlorite, to eliminate or reduce the bleaching activity of the chlorine materials. For color fidelity purposes, it is generally suitable to incorporate enough chlorine scavenger to neutralize about 1–10 ppm chlorine in the laundry bath, typically to neutralize at least about 1 ppm in the laundry bath. For the additional elimination or reduction of fabric chlorine odor resulting from the use of a chlorine bleach in the wash, the compositions should contain enough chlorine scavenger to neutralize at least about 10 ppm in the laundry bath.

Such compositions according to the present invention provide about 0.1 ppm to about 40 ppm, preferably from about 0.2 ppm to about 20 ppm, and more preferably from about 0.3 ppm to about 10 ppm of chlorine scavenger to an average laundry bath. Suitable levels of chlorine scavengers in the compositions of the present invention range from about 0.01% to about 15%, preferably from about 0.02% to about 10%, most preferably from about 0.25% to about 5%, by weight of total composition. If both the cation and the anion of the scavenger react with chlorine, which is desirable, the level may be adjusted to react with an equivalent amount of available chlorine.

Non-limiting examples of chlorine scavengers include primary and secondary amines, including primary and secondary fatty amines; ammonium salts, e.g., chloride, sulfate; amine-functional polymers; amino acid homopolymers with amino groups and their salts, such as polyarginine, polylysine, polyhistidine; amino acid copolymers with amino groups and their salts; amino acids and their salts, preferably those having more than one amino group per molecule, such as arginine, histidine, not including lysine reducing anions such as sulfite, bisulfite, thiosulfate, nitrite; antioxidants such as ascorbate, carbamate, phenols; and mixtures thereof Ammonium chloride is a preferred inexpensive chlorine scavenger for use herein.

Other useful chlorine scavengers include water-soluble, low molecular weight primary and secondary amines of low volatility, e.g., monoethanolamine, diethanolamine, tris (hydroxymethyl)aminomethane, hexamethylenetetramine. Suitable amine-functional chlorine scavenger polymers include: water-soluble polyethyleneimines, polyamines, polyvinylamines, polyamineamides and polyacrylamides. The preferred polymers are polyethyleneimines, the polyamines, and polyamineamides. Preferred polyethyleneimines have a molecular weight of less than about 2000, more preferably from about 200 to about 1800.

V. Dye Transfer Inhibiting Agents

The compositions of the present invention may also include one or more materials effective for inhibiting the transfer of dyes from one fabric to another during the laundry process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.1% to about 15% by weight of the composition, preferably from about 0.1% to about 10%, and more preferably from about 0.5% to about 5%.

More specifically, the polyamine N-oxide polymers preferred for use herein contain units having the following structural formula: $R—A_x—Z$; wherein Z is a polymerizable unit to which an N—O group can be attached or the N—O group can form part of the polymerizable unit or the N—O group can be attached to both units; A is one of the following structures: —NC(O)—, —C(O)O—, —S—, —O—, —N=; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

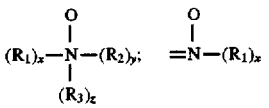

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed has dye transfer inhibiting properties. Preferred polymers are those which are water-soluable. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the rinse added compositions and processes herein is poly(4-vinylpyridine-N-oxide) which has an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis*, Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

The compositions herein may also optionally contain from about 0.005% to 5% by weight of certain types of hydrophilic optical brighteners which also provide a dye transfer inhibition action. If used, the compositions herein will preferably comprise from about 0.1% to 3.5% by weight of such optical brighteners.

The hydrophilic optical brighteners useful in the present invention are those having the structural formula:

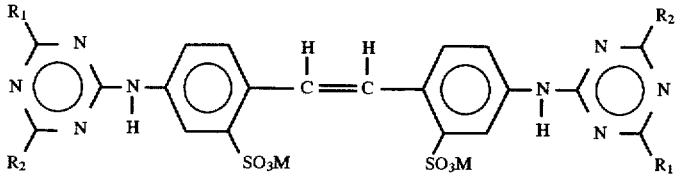

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4'-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the rinse added compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous solutions than does either of these two components when used alone. Without being bound by theory, it is believed that such brighteners work this way because they have high affinity for fabrics in the aqueous solution and therefore deposit relatively quick on fabrics. The extent to which brighteners deposit on fabrics in solution can be defined by a parameter called the "exhaustion coefficient". The exhaustion coefficient is in general defined as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally also be used in the present compositions to provide conventional fabric "brightness" benefits, rather than a true dye transfer inhibiting effect.

VI. Cellulase Enzymes

The compositions of the present invention may also include a cellulase enzymes which may also contribute to overall fabric appearance improvements. A wide variety of cellulase enzymes are known from the detergency, food and papermaking arts.

The cellulases usable in the compositions and processes herein can be any bacterial or fungal cellulase. Suitable cellulases are disclosed, for example, in GB-A-2 075 028, GB-A-2 095 275 and DE-OS-24 47 832, all incorporated herein by reference in their entirety.

Examples of such cellulases are cellulase produced by a strain of *Humicola insolens* (*Humicola grisea* var. thermoidea), particularly by the Humicola strain DSM 1800, and cellulase 212-producing fungus belonging to the genus Aeromonas, and cellulase extracted from the hepatopancreas of a marine mullosc (Dolabella Auricula Solander).

The cellulase added to the composition of the invention may be in the form of a non-dusting granulate, e.g. "marumes" or "prills", or in the form of a liquid, e.g., one in which the cellulase is provided as a cellulase concentrate suspended in e.g. a nonionic surfactant or dissolved in an aqueous medium. Preferred cellulases for use herein are characterized in that they provide at least 10% removal of immobilized radioactive labeled carboxymethyl-cellulose according to the $C^{14}$ CMC-method described in EPA 350 098 (incorporated herein by reference in its entirety) at $25\times10^{-6}$% by weight of cellulase protein in the laundry test solution.

Most preferred cellulases are those as described in International Patent Application WO91/17243, incorporated herein by reference in its entirety. For example, a cellulase preparation useful in the compositions of the invention can consist essentially of a homogeneous endoglucanase component, which is immunoreactive with an antibody raised against a highly purified 43 kD cellulase derived from *Humicola insolens*, DSM 1800, or which is homologous to said 43 kD endoglucanase.

The cellulases herein should be used in the compositions of the present invention at a level equivalent to an activity from about 0.1 to about 125 CEVU/gram of composition [CEVU=Cellulase (equivalent) Viscosity Unit, as described, for example, in WO 91/13136, incorporated herein by reference in its entirety], and most preferably about 5 to about 100. Such levels of cellulase are selected to provide the herein preferred cellulase activity at a level such that the compositions deliver an appearance-enhancing and/or fabric softening amount of cellulase below about 50 CEVU's per liter of rinse solution, preferably below about 30 CEVU's per liter, more preferably below about 25 CEVU's per liter, and most preferably below about 20 CEVU's per liter, during the rinse cycle of a machine washing process. Preferably, the present invention compositions are used in the rinse cycle at a level to provide from about 1 CEVU's per liter rinse solution to about 50 CEVU's per liter rinse solution, more preferably from about 2 CEVU's per liter to about 30 CEVU's per liter, even more preferably from about 5 CEVU's per liter to about 25 CEVU's per liter, and most preferably from about 5 CEVU's per liter to about 15 CEVU's per liter.

The CAREZYME and BAN cellulases, such as those available from NOVO, are especially useful herein. If used, such commercial enzyme preparations will typically comprise from about 0.001% to about 2%, by weight, of the present compositions.

VII. Free Radical Scavengers

The present invention may also include a free radical scavenger or antioxidant to reduce the fading of fabrics from sunlight and/or oxygen bleaches. The composition may comprise from about 0.1% to about 25%, preferably from about 0.1% to about 15%, more preferably from about 5% to about 15%, by weight of the composition, of a non-fabric staining, light stable, antioxidant compound preferably containing at least one $C_8$–$C_{22}$ hydrocarbon fatty organic moiety, more preferably at least one $C_{12}$ to $C_{18}$ hydrocarbon fatty organic moiety; wherein the antioxidant compound is a solid having a melting point of less than about 80° C., preferably less than about 50° C., or a liquid at a temperature of less than about 40° C.; preferably from about 0° C. to about 25° C.

Preferably these antioxidant compounds are selected from the group consisting of:

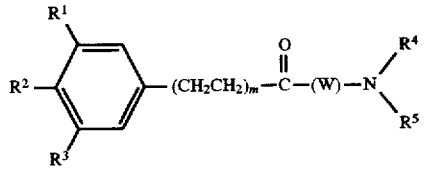

(I)

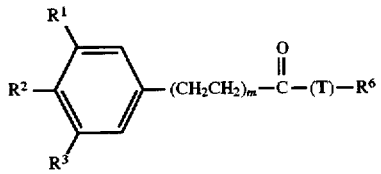

(II)

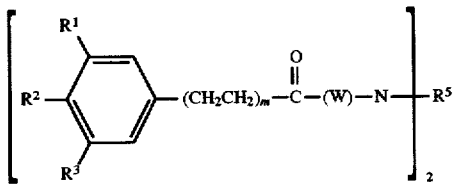

(III)

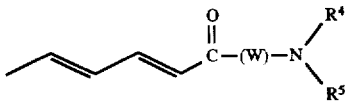

(IV)

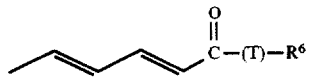

(V)

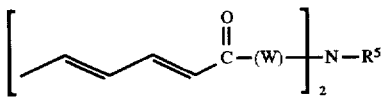

(VI)

and mixtures thereof (VII);

wherein $R^1$ and $R^3$ are the same or different moiety selected from the group consisting of hydroxy, $C_1$–$C_6$ alkoxy groups (i.e. methoxy, ethoxy, propoxy, butoxy groups), branched or straight chained $C_1$ to $C_6$ alkyl groups, and mixtures thereof, preferably branched $C_1$ to $C_6$ alkyl groups, more preferably "tert"-butyl groups;

$R^2$ is a hydroxy group;

$R^4$ is a saturated or unsaturated $C_1$ to $C_{22}$ alkyl group or hydrogen, preferably a methyl group;

$R^5$ is a saturated or unsaturated $C_1$ to $C_{22}$ alkyl group which can contain ethoxylated or propoxylated groups, preferably a saturated or unsaturated $C_8$ to $C_{22}$ alkyl group, more preferably a saturated or unsaturated $C_{12}$ to $C_{18}$ alkyl group, and even more preferably a saturated or unsaturated $C_{12}$ to $C_{14}$ alkyl group;

$R^6$ is a branched or straight chained, saturated or unsaturated, $C_8$ to $C_{22}$ alkyl group, preferably a branched or straight chained, saturated or unsaturated $C_{12}$ to $C_{18}$ alkyl group, more preferably a branched or straight chained, saturated or unsaturated $C_{16}$ to $C_{18}$ alkyl group;

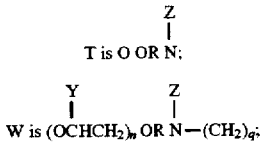

Y is a hydrogen or a $C_1$ to $C_5$ alkyl group, preferably hydrogen or a methyl group, more preferably hydrogen;

Z is hydrogen, a $C_1$ to $C_3$ alkyl group (which may be interrupted by an ester, amide, or ether group), a $C_1$ to $C_{30}$ alkoxy group (which may be interrupted by an ester, amide, or ether group), preferably hydrogen or a $C_1$ to $C_6$ alkyl group;

m is from 0 to 4, preferably from 0 to 2;

n is from 1 to 50, preferably from 1 to 10, more preferably 1; and q is from 1 to 10, preferably from 2 to 6.

The antioxidants of the present invention can also comprise quaternary ammonium salts of Formulas I, III, IV, and VI although amines of Formulas I, III, IV, and VI are preferred.

The antioxidant compounds of the present invention preferably comprise amine compounds of Formulas I, II, III, and mixtures thereof.

A preferred compound of formula (I) is 2-(N-methyl-N-cocoamino)ethyl 3',5',-di-tert-butyl-4'-hydroxybenzoate.

A preferred compound of formula (II) is Octadecyl 3,5-di-tert-butyl-4-hydroxyhydrocinnamate, known under the trade name of Irganox® 1076 available from Ciba-Geigy Co.

A preferred compound of formula (III) is N,N-bis[ethyl 3',5'-di-tert-butyl-4'-hydroxybenzoate]N-cocoamine.

A preferred compound of formula IV is 2-(N-coco-N-methylamino)ethyl 2',4'-trans, trans-hexadienoate.

The preferred antioxidants of the present invention include 2-(N-methyl-N-cocoamino)ethyl 3',5'-di-tert-butyl-4'-hydroxybenzoate; 2-(N,N-dimethyl-amino)ethyl 3',5'-di-tert-butyl-4'-hydroxybenzoate; 2-(N-methyl-N-cocoamino) ethyl 3',4',5'-trihydroxybenzoate; and mixtures thereof, more preferably 2-(N-methyl-N-cocoamino)ethyl 3',5'-di-tert-butyl-4'-hydroxy benzoate. Of these compounds the butylated derivatives are preferred in the compositions of the present invention because tri-hydroxybenzoates have a tendency to discolor upon exposure to light.

The antioxidant compounds of the present invention demonstrate light stability in the compositions of the present invention. "Light stable" means that the antioxidant compounds in the compositions of the present invention do not discolor when exposed to either sunlight or simulated sunlight for approximately 2 to 60 hours at a temperature of from about 25° C. to about 45° C.

Antioxidant compounds and free radical scavengers can generally protect dyes from degradation by first preventing the generation of singlet oxygen and hydroxy/peroxy radicals, and thereafter terminating the degradation pathways. Not to be limited by theory, a general discussion of the mode of action for antioxidants and free radical scavengers is disclosed in Kirk Othmer, The Encyclopedia of Chemical Technology, Volume 3, pages 128–148, Third Edition (1978), which is incorporated herein by reference in its entirety.

The composition of the present invention deposits from about 0.5 mg/g fabric to about 5 mg/g fabric of the antioxidants to reduce the sun fading of the fabric or protect against oxygen bleach damage.

Treatment of fabric with compositions of the present invention repeatedly may result in higher deposition levels, which contributes even further to the anti-fading benefit.

Conventional antioxidants are generally less suitable for application to fabric because they less effectively deposit on surfaces, they sometimes discolor fabrics, they are not always stable or compatible with other components in the composition, and they are often expensive.

Preferred antioxidant compounds and methods of making them are disclosed in P&G Copending Application Serial No. 08/280,685, Sivik and Severns, filed on Jul. 26, 1994, which is herein incorporated by reference.

VIII. Carrier Ingredients

A carrier such as a liquid carrier may be employed in the present invention. If a liquid carrier is employed in the instant compositions, the carrier is preferably water due to its low cost, relative availability, safety, and environmental compatibility. The level of water in the liquid carrier is generally more than about 50%, preferably more than about 80%, more preferably more than about 85%, by weight of the carrier. The level of liquid carrier is generally greater than about 20%, preferably greater than about 40%, more preferably greater than about 60%. Mixtures of water and low molecular weight, e.g., <about 100, organic solvent, e.g., lower alcohol such as ethanol, propanol, isopropanol or butanol; propylene carbonate; and/or glycol ethers, are useful as the carrier liquid. Low molecular weight alcohols include monohydric such as $C_{14}$ monohydric alcohols, dihydric (glycol, etc.) trihydric (glycerol, etc.), and polyhydric (polyols) alcohols, such as $C_{2-6}$ polyhydric alcohols.

The compositions of the present invention may be employed as sprayable foams, sprays or preferably pre-soak or rinse added liquids. When employed as a sprayable composition, conventional spray dispensers may be employed. The dispenser may be an aerosol, self-pressurized non-aerosol, non-aerosol, manually activated pump-spray dispenser or manually activated trigger spray dispenser. A complete description of commercially available aerosol-spray dispensers appears in U.S. Pat. Nos. 3,436,772, Stebbins issued Apr. 8, 1969 and 3,600,325 Kaufman et al issued Aug. 17, 1971, the disclosures of which are herein incorporated by reference. A complete description of self-pressurized spray dispensers can be found in U.S. Pat. Nos. 5,111,971 Winer issued May 12, 1992 and 5,232,126 Winer issued Aug. 3, 1993, the disclosures of which are herein incorporated by reference. A complete description of commercially available manual pump dispensing devices appears in U.S. Pat. Nos. 4,895,279, Schultz issued Jan. 23, 1990, 4,735,347, Schultz et al issued Apr. 5, 1988 and 4,274,560 Carter, issued Jun. 23, 1981, the disclosures of which are herein incorporated by reference. A complete description of trigger spray dispensers appears in U.S. Pat. Nos. 4,082,223, Nozawa issued Apr. 4, 1978, 4,161,288, McKinney issued Jul. 17, 1985, 4,434,917 Saito et al issued Mar. 6, 1984, 4,819,835 Tasaki issued Apr. 11, 1989 and 5,303,867, Peterson issued Apr. 19, 1994, the disclosures of which are all herein incorporated by reference.

Other preferred optional ingredients include, but are not limited to, polymeric dispersing agents, suds suppressors, optical brighteners or other brightening or whitening agents, fabric softening clay, anti-static agents, other active ingredients, carriers, hydrotropes, processing aids, dyes or pigments, bacteriocides, colorants, perfumes, preservatives, opacifiers, anti-shrinkage agents, additional anti-wrinkle agents, fabric crisping agents, spotting agents, germicides, fungicides, anti-corrosion agents, and the like.

The compositions of the present invention can provide numerous benefits to laundered garments or fabrics as opposed to prior art compositions. These benefits include fabric softness, improved water absorbency, anti-wrinkling, improved color appearance and wear reduction. While not wishing to be bound by theory, through the use of the dispersible polyolefin and, in particularly, the dispersible polyethylene the benefits of improved color appearance, anti-wrinkling, water absorbency, static control and fabric softness are provided.

The compositions of the present invention provide a color appearance benefit. That is, the compositions of the present invention can improve the overall appearance of fabrics which are treated in the compositions of the present invention. This improved color appearance can be manifested in simple overall appearance of the fabrics or in the reduction of pilling. Colored fabrics have a tendency to lose color and become duller in appearance as a result of multiple launderings. One mechanism by which fabrics lose color is abrasion. Fabrics moving past one another and against the washing machine tub during laundering tend to "rough-up" their surfaces, resulting in microfibrils appearing on the surface of the fibers in the garment. Macroscopically, this appears as "fuzzing" or "dulling" of the color of the item. Furthermore, fabrics may begin to fray (wear), especially around seams, by a similar mechanism as a result of repeated launderings.

While not wishing to bound by theory, the use of lubricants such a polyolefins dispersed in a laundry composition, decreases the frictional forces encountered by the fabrics during the laundering process, thereby decreasing the fuzzing and fraying of the fibers. To the consumer, treated garments have colors more true to their original condition and appear less "worn-out" after multiple washings.

The compositions of the present invention may also provide wrinkle reduction properties to garments or fabrics. Through use of the compositions of the present invention, wrinkle reduction properties can be provided to garments which have not been previously treated with a wrinkle reducing agent. In addition, the compositions of the present invention may restore or refurbish the wrinkle reduction properties to garments or fabrics which have previously been treated with a wrinkle reducing agent or, in other words, durable press garments. Fabrics, especially cotton, have a tendency to wrinkle during the laundering process. Wrinkling is caused at the fiber level by the inability of the fibers to readily slip past one another in response to stresses applied to the fabric during laundering. The fibers can become "stuck" in the wrong configuration, thus leading to a wrinkle on the macroscopic level.

While not wishing to be bound by theory, it is believed that the polyolefin in the composition described herein serves as a lubricant between fibers, allowing them to slip past one another more easily. Thus, during laundering, the fabrics have a decreased propensity to wrinkle. To the consumer, the end result is garments which are less wrinkled at the end of the laundering event. Therefore, less ironing is required for the consumer to achieve the desired end result. In fact, some items of clothing may no longer need to be ironed as a result of treatment with the compositions herein. For those treated items that are still ironed, less time is required and the task is made easier due to the lubrication properties of the polyolefin.

In addition, the compositions of the present invention may provide improved water absorbency benefits. That is, through the use of the compositions of the present invention in conjunction with a fabric softening composition, the effect of water absorbency reduction in fabrics, especially terry type towels, may be improved or superior over the water absorbency reduction which occurs in fabrics treated with a fabric softening compound which includes a fabric softening component having a fatty nature. That is, the expected reduction in water absorbency from contact with a fabric softening compound is not as great when using the compositions of the present invention in conjunction with a fabric softening composition.

Accordingly, the present invention also comprises a method for laundering fabrics or garments by contacting the fabrics or garments with the compositions of the present invention. Most preferably, the method includes contacting the fabrics or garments with the compositions during the rinse portion or in a presoak or pretreatment portion before the wash cycle of a laundering process comprising both washing and rinsing steps. Thus, the method is also capable of providing a fabric or garment with improved color appearance properties, wrinkle reduction properties and improved water absorbency properties. The compositions can be added directly in the rinse both to provide adequate usage concentration, e.g., at least about 50 ppm and more preferably of from about 100 to about 10,000 ppm of the liquid compositions of the present invention. The compositions may be added in conjunction with other laundry products including rinse added fabric softeners. Alternatively, the compositions of the present invention may be added to a pre-soak or pretreatment stage before the wash cycle of a laundry process. When doing so, the compositions are added at adequate levels to provide usage concentration, e.g., at least about 50 ppm and more preferably of from about 100 to about 10,000 ppm of the liquid compositions of the present invention. Alternatively, the compositions may be sprayed onto fabrics or otherwise directly applied as a liquid composition in either the pre-soak or rinse added stages.

The following examples illustrate the compositions of this invention, but are not intended to be limiting thereof.

EXAMPLE I

Laundry additive compositions according to the present invention are formulated as follows:

| Ingredient | A Wt. % | B Wt. % | C Wt. % | D Wt. % |
|---|---|---|---|---|
| VELUSTROL PKS (1) | 14.0 | 4.0 | 14.0 | 28.0 |
| Dye Fixative Agent (2) | 2.65 | 6.0 | 2.65 | 2.65 |
| Chelant (3) | 2.5 | 2.5 | 2.5 | 2.5 |
| Dye Transfer Inhibitor (4) | 3.0 | 0.0 | 0.0 | 3.0 |
| Free Radical Scavenger (5) | 14.0 | 0.0 | 14.0 | 14.0 |
| Cellulase Enzyme (6) | 0.0 | 0.0 | 1.0 | 0.7 |

-continued

| Ingredient | A Wt. % | B Wt. % | C Wt. % | D Wt. % |
|---|---|---|---|---|
| Ammonium Chloride | 0.5 | 0.5 | 0.5 | 0.5 |
| Water and Minors (7) | to 100 | to 100 | to 100 | to 100 |

(1) Cationic polyethylene emulsion available from HOECHST Aktiengesellschaft
(2) SANDOFIX TP (53% active)
(3) Diethylenetriaminepentaacetate, Na salt (41% active)
(4) poly(4-vinylpyridine-N-oxide)
(5) 2-(N-methyl-N-cocoamino)ethyl 3',5',-di-tert-butyl-4'-hydroxybenzoate
(6) CAREZYME ®, stock solution of 5,000 CEVU/g
(7) Minors include pH adjustment agents, perfumes and dyes as desired

EXAMPLE II

Laundry additive compositions according to the present invention are formulated as follows:

| Ingredient | A Wt. % | B Wt. % | C Wt. % | D Wt. % |
|---|---|---|---|---|
| VELUSTROL PKS (1) | 14.0 | 4.0 | 14.0 | 24.0 |
| Dye Fixative Agent (2) | 0.0 | 6.0 | 2.65 | 6.0 |
| Chelant (3) | 2.5 | 0.0 | 2.5 | 2.5 |
| Dye Transfer Inhibitor (4) | 0.0 | 0.0 | 0.0 | 0.0 |
| Free Radical Scavenger (5) | 0.0 | 0.0 | 14.0 | 0.0 |
| Cellulase Enzyme (6) | 0.0 | 0.0 | 0.0 | 1.0 |
| Ammonium Chloride | 0.5 | 0.0 | 0.5 | 0.5 |
| Water and Minors (7) | to 100 | to 100 | to 100 | to 100 |

(1) Cationic polyethylene emulsion available from HOECHST Aktiengesellschaft
(2) SANDOFIX TP (53% active)
(3) Diethylenetriaminepentaacetate, Na salt (41% active)
(4) poly(4-vinylpyridine-N-oxide)
(5) 2-(N-methyl-N-cocoamino)ethyl 3',5',-di-tert-butyl-4'-hydroxybenzoate
(6) CAREZYME ®, stock solution of 5,000 CEVU/g
(7) Minors include pH adjustment agents, perfumes and dyes as desired

EXAMPLE III

The liquid laundry composition of EXAMPLES I formula A was prepared as follows:

A concentrated solution of hydrochloric acid was added to an aqueous solution of the sodium salt of diethylene triamine pentaacetic acid (41% DTPA) having a pH of 12.5. The resulting solution had a pH of 5.4 and contained approximately 38% DTPA. 6.6 grams of the acidified DTPA solution was added to 50 grams of VELUSTROL PKS, a cationic polyethylene emulsion, with stirring. To this mixture were added the following ingredients in order, with stirring: 5.0 grams of SANDOFIX TP (53% active), 8.6 grams of a 35% aqueous solution of PVNO polymer (poly(4-vinylpyridine-N-oxide)); 2.0 grams of a 25% solution of ammonium chloride and 27.8 grams of distilled water.

What is claimed is:

1. A rinse added laundry composition comprising:

a) from about 0.1% to about 50% by weight of the composition of a dispersible polyolefin;

b) at least one component selected from the group consisting of:

i) from about 0.1% to about 15% by weight of the composition of a dye fixative agent;

ii) from about 0.1% to about 15% by weight of the composition of a chelating agent;

iii) from about 0.1% to about 15% by weight of the composition of a dye transfer inhibiting agent; and iv) from about 0.1% to about 25% by weight of the composition of a free radical scavenging agent;

c) from about 0.1% to about 15% by weight of the composition of a chlorine scavenging agent selected from the group consisting of primary and secondary fatty amines, ammonium chloride, ammonium sulfate, amino acid homopolymers with amino groups and their salts, amino acids and their salts, primary and secondary amines, polyethyleneimines, polyamines, polyvinylamines, polyamineamides, polyacrylamides, and mixtures thereof;

d) optionally from about 1 CEVU/g of laundry solution to about 125 CEVU/g of the composition of a cellulase enzyme; and e) the balance a carrier material.

2. The laundry additive composition as claimed in claim 1 wherein said dispersible polyolefin is added as an emulsion or suspension of polyolefin.

3. The laundry additive composition as claimed in claim 2 wherein said dispersible polyolefin is added as an emulsion and said emulsion comprises from about 10% to about 35% by weight of polyolefin.

4. The laundry additive composition as claimed in claim 3 wherein said dispersible polyolefin is added as an emulsion or suspension of polyolefin and said emulsion or suspension of polyolefin is added at sufficient levels to provide from about 1% to about 30% by weight of said composition of dispersible polyolefin.

5. The laundry additive composition as claimed in claim 3 further including an emulsifier in said polyolefin emulsion and wherein the ratio of emulsifier to polyolefin in said polyolefin emulsion is from about 1:5 to about 3:1.

6. The laundry additive composition as claimed in claim 1 wherein said dispersible polyolefin is a polyethylene.

7. The laundry additive composition as claimed in claim 6 wherein said polyethylene is an oxidized polyethylene.

8. The laundry additive composition as claimed in claim 5 wherein said emulsifier is a cationic, anionic, zwitterionic or nonionic surfactant.

9. A liquid pre-soak or rinse added laundry composition comprising:

from about 1% to about 30% by weight of the composition of a dispersible polyolefin;

from about 0.25% to about 10% by weight of the composition of a dye fixative agent;

from about 0.5% to about 10% by weight of the composition of a chelating agent;

from about 0.25% to about 5% by weight of the composition of a chlorine scavenging agent selected from the group consisting of primary and secondary fatty amines, ammonium chloride, ammonium sulfate, amino acid homopolymers with amino groups and their salts, amino acids and their salts, primary and secondary amines, polyethyleneimines, polyamines, polyvinylamines, polyamineamides, polyacrylamides, and mixtures thereof; and the balance a liquid carrier selected from the group consisting of: water; $C_{1-4}$ monohydric alcohol; $C_{2-6}$ polyhydric alcohol; propylene carbonate; liquid polyethylene glycols; and mixtures thereof.

10. The laundry composition as claimed in claim 9 wherein said dispersible polyolefin is added as a polyethylene emulsion or suspension.

11. The laundry composition as claimed in claim 10 wherein said polyethylene is an oxidized polyethylene.

12. The laundry composition as claimed in claim 10 wherein said dispersible polyolefin is added as an emulsion or suspension of polyolefin and said emulsion or suspension of polyolefin is added at sufficient levels to provide from about 1% to about 30% by weight of said composition of dispersible polyolefin.

13. The laundry composition as claimed in claim 10 wherein said composition further includes at least one of the group consisting of cellulase enzymes, dye transfer inhibiting agents and free radical scavenging agents.

* * * * *